United States Patent [19]

Hergt et al.

[11] Patent Number: 4,564,334

[45] Date of Patent: Jan. 14, 1986

[54] GUIDE WHEEL FOR MULTISTAGE CENTRIFUGAL PUMPS

[75] Inventors: Peter Hergt, Ludwigshafen; Alexander Nicklas, Dirmstein; Karl-Heinz Becker, Worms, all of Fed. Rep. of Germany

[73] Assignee: Klein, Schanzlin & Becker Aktiengesellschaft, Frankenthal, Fed. Rep. of Germany

[21] Appl. No.: 604,075

[22] Filed: Apr. 26, 1984

[30] Foreign Application Priority Data

Apr. 28, 1983 [DE] Fed. Rep. of Germany ..... 3315350

[51] Int. Cl.[4] ..... F04D 29/44

[52] U.S. Cl. ..... 415/199.3; 415/210

[58] Field of Search ..... 415/199.1, 199.3, 210, 415/211, 205, 207, 209, 199.2

[56] References Cited

U.S. PATENT DOCUMENTS

| | | | |
|---|---|---|---|
| 984,189 | 2/1911 | Brown | 415/199.3 |
| 1,857,486 | 5/1932 | Trumpler | 415/199.3 X |
| 2,596,646 | 5/1952 | Buchi | 415/210 X |
| 3,051,090 | 8/1962 | Zumbusch | 415/199.1 |
| 3,171,353 | 3/1965 | McMahan | 415/210 X |

*Primary Examiner*—Robert E. Garrett
*Assistant Examiner*—Joseph M. Pitko
*Attorney, Agent, or Firm*—Peter K. Kontler

[57] ABSTRACT

The follow-up guide wheels of a multistage centrifugal pump define flow paths whose cross-sectional area increases exclusively in the axial direction of the respective stages, or axially and radially inwardly, to thus allow for a reduction of the outer diameters of the guide wheels without reducing the efficiency of the pump.

15 Claims, 3 Drawing Figures

GUIDE WHEEL FOR MULTISTAGE CENTRIFUGAL PUMPS

BACKGROUND OF THE INVENTION

The present invention relates to multistage centrifugal pumps in general, and more particularly to improvements in multistage centrifugal pumps with follow-up diffusers or guide rings which are disposed downstream of the impellers and serve to direct the liquid medium into the next-following pump stages.

Centrifugal pump technology has developed certain standards for the design of the impellers and of the follow-up diffusers or guide rings in such fluid flow machines. A distinguishing characteristic of a guide ring is a flow path or passage with an increasing cross-sectional area in the direction of flow, and the guide ring can perform one or more functions including deceleration, deflection and/or return flow of the conveyed fluid medium. The neighboring passages of a guide ring are separated from each other by guide vanes or blades. The important parameters of such passages include their length and the ratio of the areas of their inlets and outlets. The length of the passage is normally between two and four times the width of the inlet and the area of the outlet is between 1.3 and 1.7 times the area of the inlet. The area of the inlet (also called inlet eye) equals the width of the inlet of the passage, as measured in the radial direction, multiplied by the width of the guide wheel as measured in the axial direction of the pump. The width of the inlet is an imaginary line extending orthogonally from the inner end portion of one blade to the next blade.

A further parameter which is normally considered in the design of multistage centrifugal pumps is the diameter ratio D5/D2 which is dependent upon the number of blades and the specific speed. Such ratio is normally between 1.2 and 1.5. D5 denotes the outer diameter of the guide wheel and D2 denotes the outer diameter of the impeller.

A drawback of many presently known multistage centrifugal pumps is that the outer diameter of the pump housing is too large and that it cannot be reduced without adversely affecting the efficiency of the pump.

OBJECTS AND SUMMARY OF THE INVENTION

An object of the invention is to provide a novel and improved multistage centrifugal pump whose housing has an outer diameter which is smaller than the outer diameters of housings of conventional centrifugal pumps with the same output.

Another object of the invention is to provide a novel and improved housing for use in a multistage centrifugal pump.

A further object of the invention is to provide novel and improved guide wheels for use in a multistage centrifugal pump and to provide a novel and improved multistage centrifugal pump which embodies the novel guide wheels.

An additional object of the invention is to provide a multistage centrifugal pump wherein the ratio of the outer diameters of guide wheels to the outer diameters of impellers is much more satisfactory than in heretofore known multistage centrifugal pumps.

Still another object of the invention is to provide a novel and improved method of reducing the ratio of the outer diameters of guide wheels to the outer diameters of impellers in a multistage centrifugal pump.

An ancillary object of the invention is to provide a multistage centrifugal pump which is cheaper than but just as reliable as conventional centrifugal pumps with the same output.

The invention resides in the provision of a multistage centrifugal pump wherein each stage comprises a rotary impeller which is driven by the pump shaft and has means for discharging the conveyed fluid medium substantially radially outwardly, and a guide wheel for each impeller. Each guide wheel has blades which define passages for the flow of fluid medium from the discharging means of the respective impeller and each passage has an inlet, an outlet, a first section which diverges laterally and substantially axially of the guide wheel, and a second section which is disposed downstream of the first section and diverges substantially radially inwardly of the guide wheel. The pump further comprises a housing which surrounds the guide wheels, and each passage of each guide wheel has a portion which is adjacent to the internal surface of the housing, i.e., each guide wheel is open toward the housing in the region of each of its passages.

The outer surfaces of the guide wheels are cylindrical and are adjacent to the pump housing, the inner end portions of the blades of each guide wheel are remote from the corresponding outer surface and the outer end portions of such blades are adjacent to the corresponding outer surface. In order to reduce the radial dimensions of the guide wheels, the difference between the diameter of the outer surface of each guide wheel and the diameter of the circle which is formed by the inner end portions of the respective blades at most equals the combined width of the inlet of a passage, of one of the inner end portions and of one of the outer end portions, as considered in the radial direction of the respective guide wheel.

The second section of each passage preferably begins at a predetermined distance from the inner end portion of the corresponding blade. The magnitude of such distance may be between zero and a wherein a denotes the width of the inlet of the passage.

Each guide wheel preferably includes a circumferentially extending wall having a surface which is disposed in a plane making an angle of 90 degrees with the axis of the pump shaft. The first section of each passage is then adjacent to one side of such surface of the respective wall. The arrangement is preferably such that, in each guide wheel, the first sections are disposed at one side and the second sections are disposed at the other side of the aforementioned plane. The width of each first section preferably decreases, as considered axially of the respective guide wheel, in the circumferential direction of the guide wheel and in the direction of the flow of fluid medium therethrough.

The inlets of the passages are disposed radially outwardly of the fluid discharging means of the respective impeller.

The pump (e.g., each of the guide wheels) can further comprise return guide vanes which define channels serving to receive fluid medium from the outlets of the passages of the respective guide wheel, and the second sections of the passages extend toward and preferably merge into the respective channels. An annular chamber or space which is devoid of guide vanes and/or blades is preferably provided between the passages of each guide wheel and the adjacent channels.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
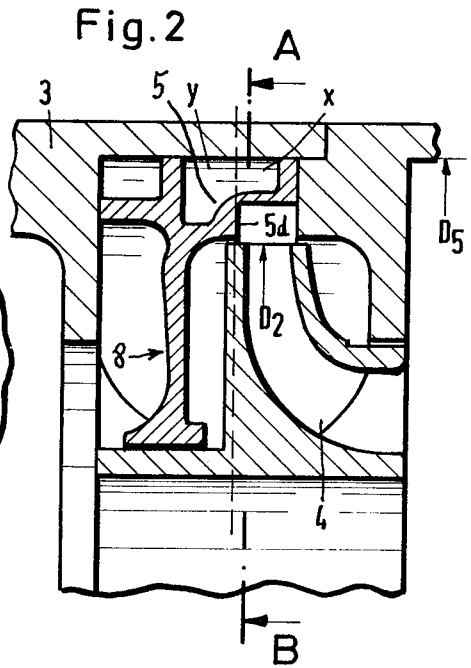
FIG. 2 is a fragmentary axial sectional view as seen in the direction of arrows from the line C—D of FIG. 1.
Figure 1:
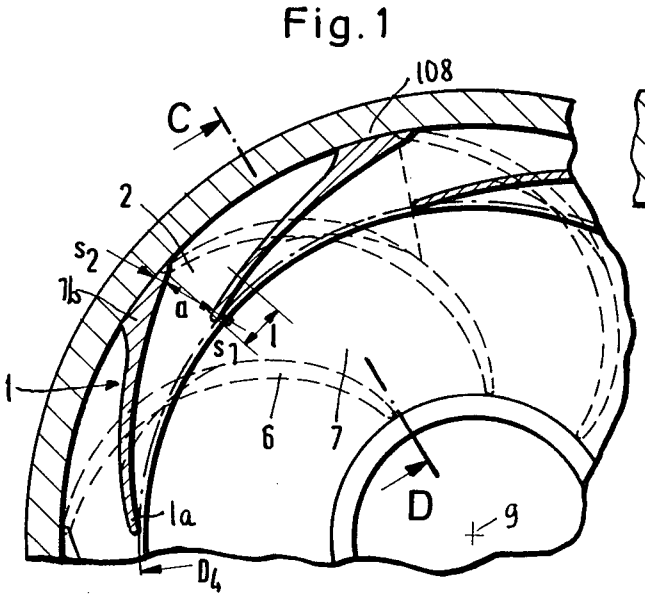
FIG. 1 is a fragmentary transverse sectional view of a multistage centrifugal pump and shows a portion of one of several guide wheels which embody one form of the invention, the section being taken in the direction of arrows as seen from the line A—B of FIG. 2.

FIGS. 1 and 2 show a portion of a multistage centrifugal pump wherein each stage comprises a rotary impeller 4 and a stationary diffuser or guide wheel 8. The guide vanes or blades 1 of the guide wheel 8 define passages or paths 2 for the flow of conveyed fluid (liquid) medium from the discharge ends of the respective impellers 4 toward the intake ends of the next-following impellers. The outer diameter of the impeller 4 which is shown in FIG. 2 is indicated by the character D2, and the outer diameter of the associated guide wheel 8 is shown at D5. The conveyed fluid medium flows outwardly (i.e., away from the pump shaft whose axis is shown at 9) and enters suitably inclined sections of the guide wheel 8 at the diameter D4 to thereupon enter the inlets of the passages 2. The guide wheels 8 are surrounded by the housing portions 3 of the respective stages. Such housing portions close the radially outermost portions of the passages 2 in the respective guide wheels 8.

Figure 3:
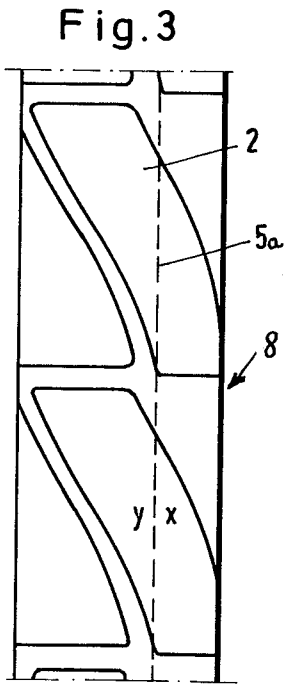
FIG. 3 is a fragmentary developed view of the guide wheel which is shown in FIGS. 1 and 2.

As shown in FIGS. 2 and 3, each passage 2 includes two sections X and Y. The section X is disposed radially outwardly of the external surface of the respective impeller 4 and is bounded (as considered in the direction of flow of liquid medium through the respective passage 2) by an imaginary plane 5*a* that extends at right angles to the axis 9 of the pump shaft and is defined by one existing side surface 5*d* of a wall 5 of the guide wheel 8. Simultaneous observation of FIGS. 2 and 3 will indicate that the section X resembles a pointed pyramid whose apex is located in the aforementioned imaginary plane 5*a*. From the section X, the conveyed liquid medium flows axially and radially inwardly in the widening section Y of the respective passage 2 which thereupon merges into one of the channels 7 defined by the neighboring return guide vanes 6 of the return stage of the centrifugal pump.

In FIG. 3, the illustrated passages 2 are open toward the observer, and this Figure further shows the manner in which each of the passages is divided into the respective sections X and Y.

FIGS. 1 and 2 show that each of the passages 2 has a portion which is adjacent to the cylindrical internal surface of the housing 3, i.e., that each such passage is open toward the housing. As mentioned above, the sections X of the passages 2 diverge laterally and substantially axially of the guide wheel 8, and the sections Y diverge axially and substantially radially inwardly of the guide wheel. The sections X are disposed at one side and the sections Y are disposed at the other side of the imaginary plane 5*a* defined by the wall 5. Also, the width of each section X decreases, as considered in the circumferential direction of the guide wheel 8 and in the direction of flow of fluid medium from the section X toward the respective section Y. FIG. 1 also shows that the section Y of each of the passages 2 begins at a predetermined distance l from the inner end portion 1*a* of the respective blade 1. The distance l can vary between zero and the width a of the inlet of the respective passage 2.

The difference between the diameter D4 of the circle which is defined by the inner end portions 1*a* of the blades 1 and the diameter D5 (i.e., the diameter of the cylindrical outer surface 108 of the guide wheel 8) at most equals the width of an inlet a, plus the width $s_1$ of an inner end portion 1*a* plus the width $s_2$ of an outer end portion 1*b*, as considered in the radial direction of the guide wheel 8. This renders it possible to reduce the aforediscussed ration D5/D2 from 1.2–1.5 to 1.1–1.4 with substantial savings in the overall dimensions of the pump. Such savings (which can amount to between 10 and 15 percent) are achieved in that the width of the passages 2 does not increase radially outwardly of the guide wheel 8 but rather axially and radially inwardly.

The aforementioned wall 5 is adjacent to the inlets of the passages 2 in the guide wheel 8 and the surface 5*d* is located at the pressure sides below the sections X, i.e., at the sides where the fluid medium flows from the impeller into the sections X. The sections X are disposed between the blades 1 and the internal surface of the housing 3. The sections Y of the passages 2 can merge gradually into the respective channels 7 which direct the fluid medium into the next stage, at least substantially without any swirl.

As mentioned above, the utilization of the improved guide wheel renders it possible to reduce the diameter of a multistage centrifugal pump by between 10 and 15 percent. The exact reduction of the outer diameter of the pump will also depend upon the specific speed as well as on the number of passages 2. In actual practice, a pronounced reduction of the outer diameter of a multistage centrifugal pump brings about substantial savings in material as well as a pronounced simplification of the making of such pumps.

It can be said that each passage 2 of the improved guide wheel 8 comprises communicating portions or sections including one (section X) which extends substantially radially and helically outwardly from the diameter D2 toward the diameter D5 along the outer side of a respective blade 1 and effects a pronounced reduction of the diameter D5, and another (section Y) which extends along the shortest path toward the respective channel 7. Such sections are disposed at the opposite sides of the plane of the surface 5*d*.

As mentioned above, the guide wheel 8 is preferably designed in such a way that it provides between the passages 2 and the channels 7 an annular space or chamber (such space or chamber cannot be seen in FIGS. 1 and 2) which is devoid of any blades and/or guide vanes. Such undertaking allows for an equalization or balancing of various streams or flows in the passages 2 and guarantees a more predictable flow of the fluid medium into the next stage of the centrifugal pump.

Moreover, the provision of the just discussed channel or space contributes to a simplification of manufacture of such multistage centrifugal pumps.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a multistage centrifugal pump, a rotary impeller having means for discharging the conveyed fluid medium; a guide wheel having an outer surface and including a plurality of blades defining passages for the flow of fluid medium from said discharging means, each of said blades having an inner end portion which is remote from said outer surface and includes a tip of the respective blade, and each of said blades further having an outer end portion adjacent to said outer surface, each of said passages having an inlet at the respective tip, and an outlet spaced from the latter, and each of said passages being devoid of constrictions between the respective inlet and outlet, each passage including a first section which extends from the respective tip and diverges laterally and substantially axially of the guide wheel, and a second section disposed downstream of the first section and diverging substantially radially inwardly and axially of the guide wheel; and a housing surrounding said guide wheel.

2. The structure of claim 1, wherein said inner end portions are disposed on a circle whose diameter is less than the diameter of said outer surface by an amount at most equal to the sum of the width of the inlet of one of said passages, the width of one of said inner end portions and the width of one of said outer end portions, as considered in the radial direction of said guide wheel.

3. The structure of claim 2, wherein said guide wheel includes a circumferentially extending wall having a surface disposed in a plane which is normal to the axis of the guide wheel, the first section of each of said passages being adjacent to such surface plane.

4. The structure of claim 3, wherein the first sections of said passages are disposed at one side and the second sections of said passages are disposed at the other side of said plane.

5. The structure of claim 4, wherein said inlets are disposed radially outwardly of the discharging means of said impeller.

6. The structure of claim 4, wherein each of said first sections decreases in width. in the circumferential direction of the guide wheel.

7. The structure of claim 2, wherein each second section is spaced from the respective tip by a predetermined distance.

8. The structure of claim 7, wherein said predetermined distance is between zero and a, a being the width of the respective inlet.

9. The structure of claim 1, further comprising return guide vanes defining channels arranged to receive fluid medium from the outlets of said passages.

10. The structure of claim 9, wherein the second sections of said passages merge into the respective channels.

11. The structure of claim 1, wherein said guide wheel further comprises return guide vanes defining channels which receive fluid medium from said passages, said guide wheel having an annular space which is disposed between said channels and said passages and is devoid of any blades and/or guide vanes.

12. The structure of claim 1, wherein each of said passages has a portion adjacent to said housing.

13. The structure of claim 1, said guide wheel having first and second axial ends; and wherein the first section of each passage is disposed between said first axial end and a predetermined location intermediate said axial ends, and the second section of each passage is disposed between said predetermined location and said second axial end.

14. The structure of claim 1, wherein the first and second section of each passage are contiguous.

15. The structure of claim 14, wherein the second section of each passage includes the respective outlet.

* * * * *